US005117566A

United States Patent [19]

Lloyd et al.

[11] Patent Number: 5,117,566

[45] Date of Patent: Jun. 2, 1992

[54] SHOE CONSTRUCTION WITH A SOLE FORMED OF PNEUMATIC TUBES

[76] Inventors: Amie J. Lloyd, 902 Corona Ave., Durham, N.C. 27707; Angela D. Lloyd, 610 E. Knox Rd. #610, Durham, N.C. 27701

[21] Appl. No.: 694,916

[22] Filed: May 2, 1991

[51] Int. Cl.[5] ..... A43B 13/20

[52] U.S. Cl. ..... 36/29; 36/28; 36/59 C; 36/30 R

[58] Field of Search ..... 36/28, 29, 35 B, 30 R, 36/59 C, 89, 44, 59 A, 30 A, 103, 3 R

[56] References Cited

U.S. PATENT DOCUMENTS

| | | | |
|---|---|---|---|
| 1,298,156 | 3/1919 | Arlidge | 36/44 |
| 2,100,492 | 11/1937 | Sindler | 36/30 A |
| 2,424,463 | 7/1947 | Hogg | 36/59 A |
| 2,627,676 | 2/1953 | Hack | 36/29 |
| 3,160,963 | 12/1964 | Aaskov | 36/29 |
| 3,419,974 | 1/1969 | Lange | 36/89 |
| 4,397,104 | 8/1983 | Doak | 36/29 |
| 4,451,994 | 6/1984 | Fowler | 36/29 |
| 4,709,490 | 12/1987 | Föttinger et al. | 36/44 |
| 4,888,887 | 12/1989 | Solow | 36/29 |
| 5,005,300 | 4/1991 | Diaz et al. | 36/28 |

FOREIGN PATENT DOCUMENTS

| | | | |
|---|---|---|---|
| 2606800 | 2/1976 | Fed. Rep. of Germany | 36/89 |
| 964740 | 4/1950 | France | 36/89 |

*Primary Examiner*—Paul T. Sewell
*Assistant Examiner*—Thomas P. Hilliard
*Attorney, Agent, or Firm*—Leon Gilden

[57] ABSTRACT

The present invention provides a shoe upper formed of a polymeric fabric mesh, with an ankle portion formed of an elastomeric polymeric material to provide support to an ankle portion of an individual. The upper includes ventilation apertures directed through a forward end of the shoe, with a first row of pneumatic tubes directed parallel to one another and coextensively with a bottom surface of the shoe, with a first resilient polymeric layer positioned interiorly of the first row of pneumatic tubes and a second row of pneumatic tubes positioned above the first resilient layer. A second polymeric layer and a third polymeric layer are respectively mounted to an interior surface in a laminated configuration, wherein each of the first, second, and third polymeric layers are of decreasing durometer of hardness to provide support and cushioning to an individual. A fluid absorbent fabric liner is formed coextensively about an interior surface of the shoe construction.

1 Claim, 3 Drawing Sheets

SHOE CONSTRUCTION WITH A SOLE FORMED OF PNEUMATIC TUBES

BACKGROUND OF THE INVENTION

1. Field of the Invention

The field of invention relates to shoe construction, and more particularly pertains to a new and improved shoe construction wherein the same is arranged to provide cover and support to an individual during use of the shoe.

2. Description of the Prior Art

Various shoe types have been utilized in the prior art to accommodate various types of activities. In the athletic type of shoe construction, comfort as well as support of an individual's foot is required during use. Examples of prior art construction of footwear are exemplified in U.S. Pat. No. 4,864,738 to Horovitz wherein a compounded sole includes a series of tubular members containing a gaseous medium therewithin.

U.S. Pat. No. 4,852,274 to Wilson sets forth a therapeutic shoe utilizing separate forces over units between an individual foot and an interior upper surface of the sole construction.

U.S. Pat. No. 4,894,932 to Harada, et al. sets forth an air shoe utilizing openings directed laterally through a sole of the shoe to provide microstructure formed with a compression less than twenty percent.

U.S. Pat. No. 4,888,887 to Solow sets forth a ventilated shoe utilizing a series of openings directed through the upper portion of the shoe for ventilation.

As such, it may be appreciated that there continues to be a need for a new and improved shoe construction as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of shoe apparatus now present in the prior art, the present invention provides a shoe construction wherein the same is arranged to provide comfort and securement to an individual mounting the shoes during use in athletic events. As such, the general purpose of the present invention, which will be described subsequently in greater detail, is to provide a new and improved shoe construction which has all the advantages of the prior art shoe apparatus and none of the disadvantages.

To attain this, the present invention provides a shoe upper formed of a polymeric fabric mesh, with an ankle portion formed of an elastomeric polymeric material to provide support to an ankle portion of an individual. The upper includes ventilation apertures directed through a forward end of the shoe, with a first row of pneumatic tubes directed parallel to one another and coextensively with a bottom surface of the shoe, with a first resilient polymeric layer positioned interiorly of the first row of pneumatic tubes and a second row of pneumatic tubes positioned above the first resilient layer. A second polymeric layer and a third polymeric layer are respectively mounted to an interior surface in a laminated configuration, wherein each of the first, second, and third polymeric layers are of decreasing durometer of hardness to provide support and cushioning to an individual. A fluid absorbent fabric liner is formed coextensively about an interior surface of the shoe construction.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved shoe construction which has all the advantages of the prior art shoe apparatus and none of the disadvantages.

It is another object of the present invention to provide a new and improved shoe construction which may be easily and efficiently manufactured and marketed.

It is a further object of the present invention to provide a new and improved shoe construction which is of a durable and reliable construction.

An even further object of the present invention is to provide a new and improved shoe construction which is susceptible of a low cost of manufacture with regard to both materials and labor, and which accordingly is then susceptible of low prices of sale to the consuming public, thereby making such shoe construction economically available to the buying public.

Still yet another object of the present invention is to provide a new and improved shoe construction which provides in the apparatuses and methods of the prior art some of the advantages thereof, while simultaneously overcoming some of the disadvantages normally associated therewith.

Still another object of the present invention is to provide a new and improved shoe construction wherein the same is arranged utilizing a fabric lower portion and an elastomeric upper portion for providing securement to an individual's foot, as well as utilizing spaced layers of pneumatic tubes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
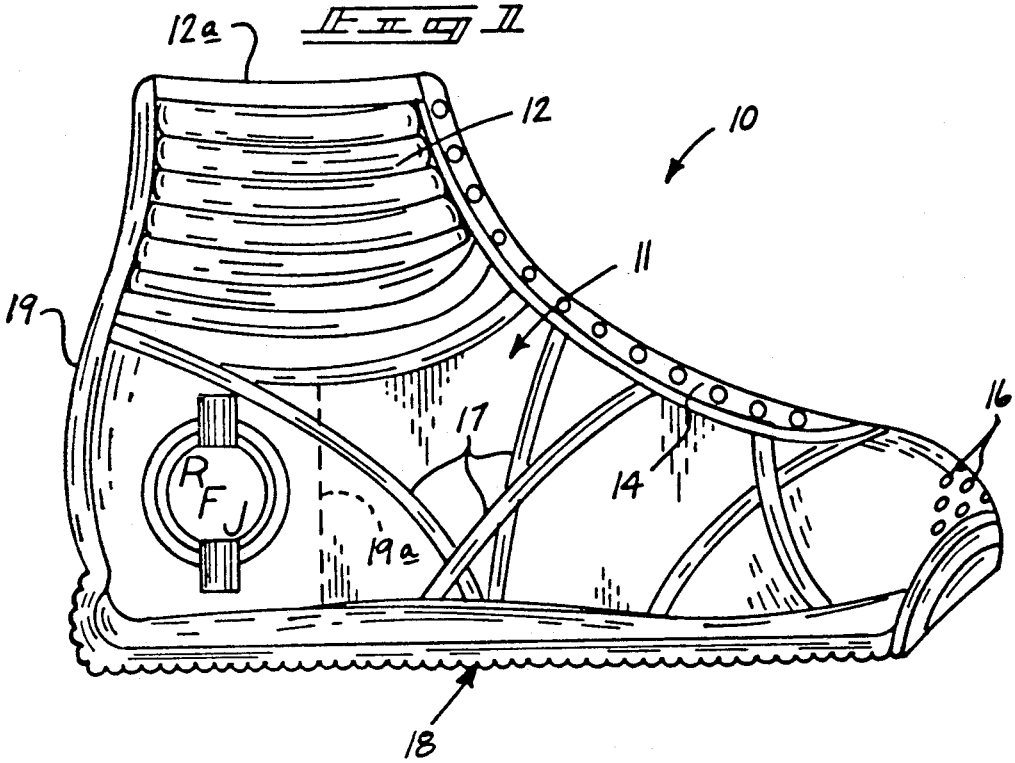
FIG. 1 is an orthographic side view, taken in elevation, of the instant invention.
Figure 2:
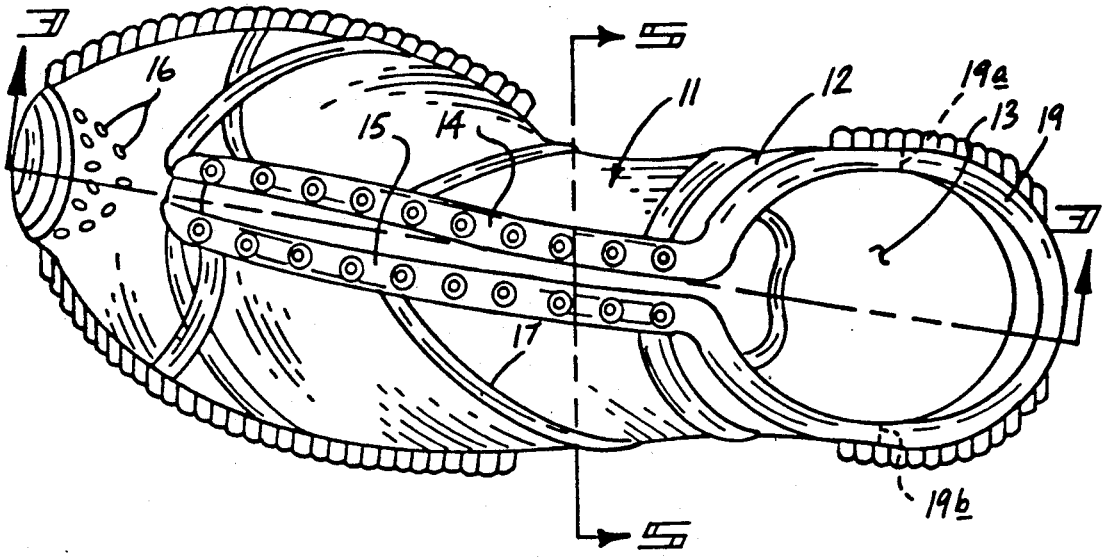
FIG. 2 is an orthographic top view of the instant invention.
Figure 3:
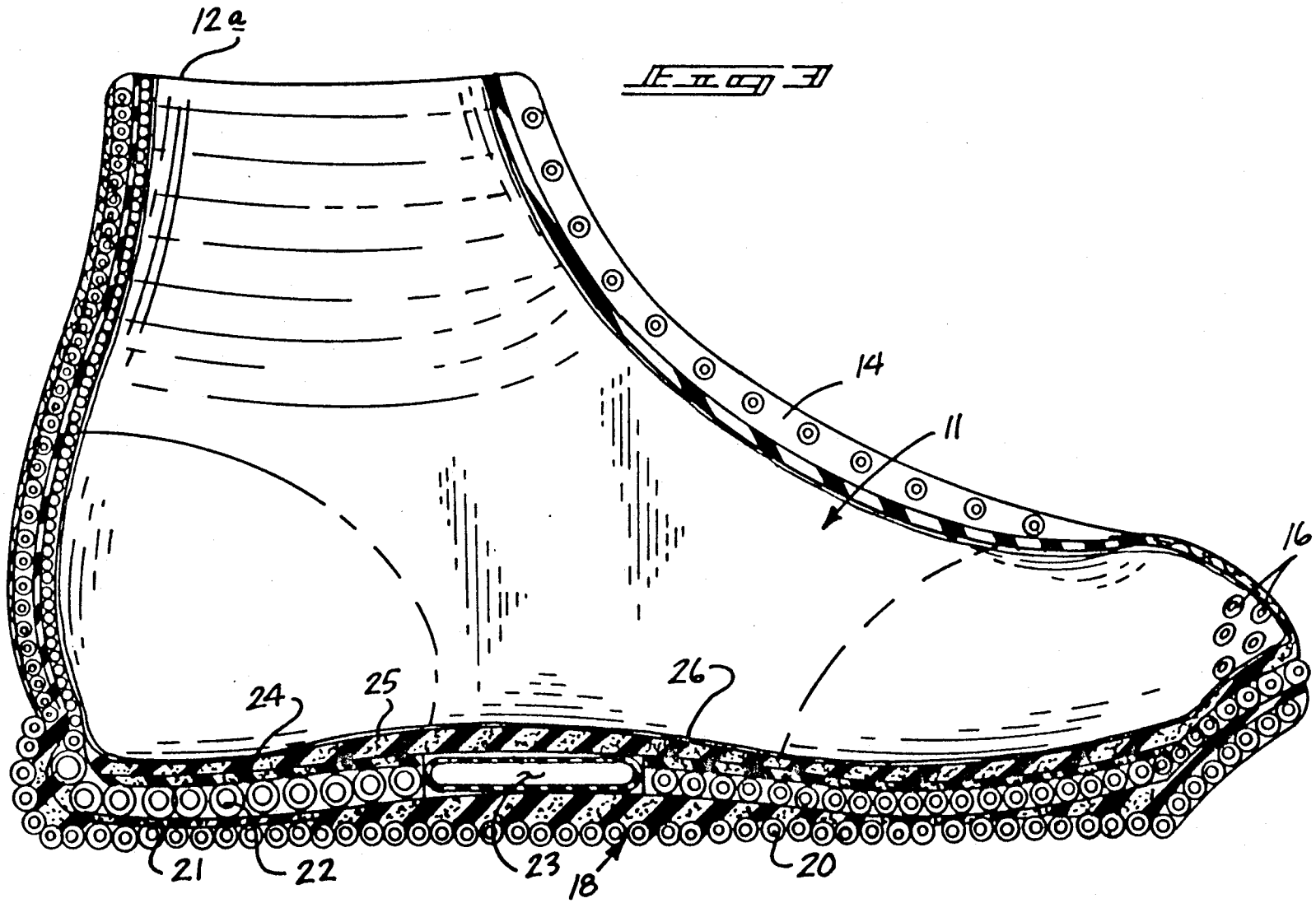
FIG. 3 is an orthographic view, taken on the lines 3—3 of FIG. 2 in the direction indicated by the arrows.

With reference now to the drawings, and in particular to FIGS. 1 to 5 thereof, a new and improved shoe construction embodying the principles and concepts of the present invention and generally designated by the reference numeral 10 will be described.

More specifically, the shoe construction 10 of the instant invention essentially comprises an organization including a shoe upper 11 formed of a fabric polymeric mesh, such as nylon and the like. The shoe upper includes a shoe upper ankle portion 13 fixedly and coextensively mounted to the shoe upper 11 and formed of an elastomeric webbing defining an entrance opening 13. The upper terminal end of the shoe upper ankle portion 12 is defined as upper terminal end 12*a*. A respective right and left reinforcing strip 14 and 15 are arranged in parallel relationship extending from the upper terminal end 12*a* downwardly along the shoe upper 11 mounting a series of eyelet openings within each reinforcing strip for receiving lacing and the like. A toe or nose end of the shoe upper 11 includes a matrix of ventilation ajpertures 16 directed therethrough, and a rear vertical upper portion 19 extends at a rear terminal end of the shoe at a remote end from the toe portion extending upwardly from the sole 18 to the upper terminal end 12*a* and is of a generally semi-cylindrical configuration extending from the right terminal end 19*a* to the left terminal end 19*b* along a minor access of the entrance opening 13 formed of an elliptical configuration. Reinforcing cords 17 are directed from the sole 18 to the reinforcing strips 14 and 15 along the shoe upper 11 and to the shoe upper ankle portion 12.

Figure 4:
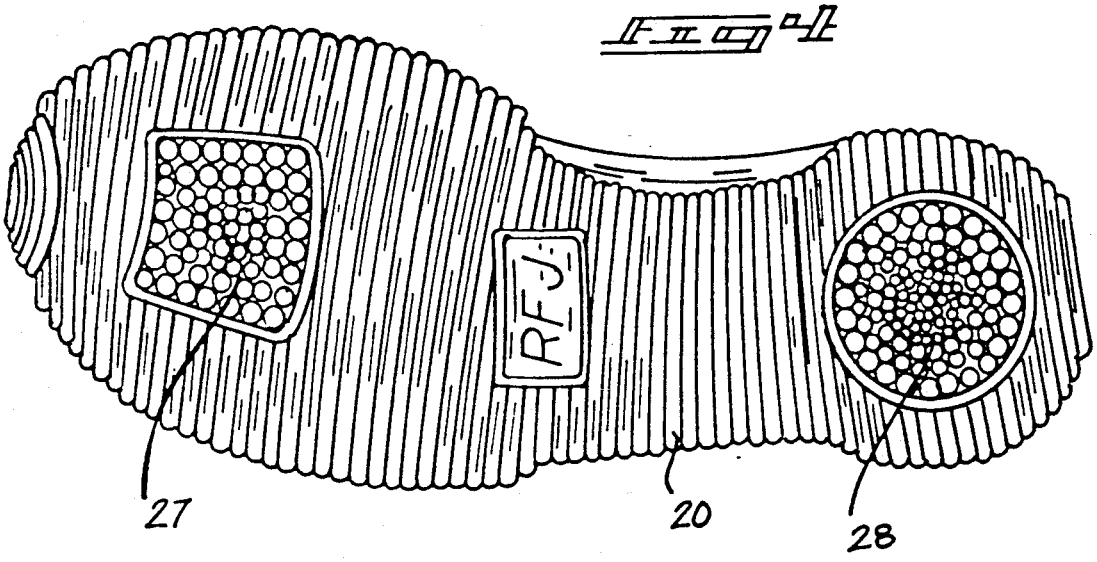
FIG. 4 is an orthographic bottom view of the instant invention.
Figure 5:
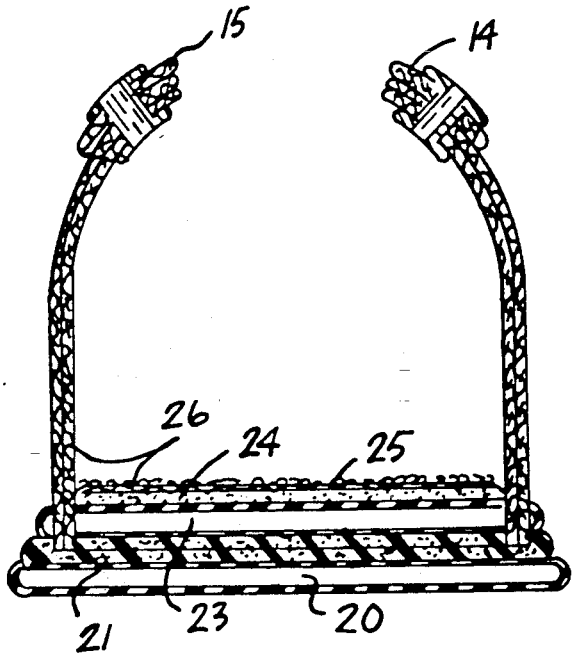
FIG. 5 is an orthographic view, taken along the lines 5—5 of FIG. 2 in the direction indicated by the arrows.

The sole 18 is formed with an outer row of pneumatic tubes 20 defining a bottom surface of a sole 18, wherein the tubes 20 are arranged in a parallel contiguous relationship relative to one another extending orthogonally relative to a longitudinal axis of the shoe connstruction 10. A first resilient polymeric layer 21 defined by a first durometer hardness is positioned interiorly of the outer row of pneumatic tubes 20. An inner row of pneumatic tubes 22 is laminated to an interior surface of the first resilient polymeric layer 21, wherein the first and second rows of pneumatic tubes 20 and 22 are each defined by parallel rows of pneumatic tubes, wherein a central inner row chamber 23 is positioned medially of the sole 18 within the inner row of pneumatic tubes, wherein the inner and outer rows of pneumatic tubes also extend throughout the rear vertical upper portion 19. The sole 18 further includes a second plymeric layer 24 laminated to an interior surface of the inner row of pneumatic tubes 22 defined by a second durometer hardness less than the first durameter hardness and third polymeric layer 25 laminated to the second polymeric layer 24 defined by a third durameter of hardness less than the first durameter of hardness to provide increasing levels of cushioning to an individual's foot while maintaining stability to the foot within the shoe construction. Further, a fluid absorbent fabric liner 26 is mounted coextensively throughout an interior surface of the shoe for absorbing fluid, such as perspiration. FIG. 4 illustrates that the outer row of pneumatic tubes 20 further include forward and rear tubes 27 and 28 defined as a matrix of tubes orthogonally oriented relative to the outer row of pneumatic tubes 20 and completely contained within the outer row of pneumatic tubes 20 to define a traction enhancing pattern in use of the shoe. Further it should be noted that each of the inner and outer rows of pneumatic tubes are totally enclosed and utilize any gaseous medium therewithin to provide cushioning of and individual's foot during use.

It should be further noted that the organization may further utilized the third polymeric layer 25 to be impregnated with a charcoal material to provide odor and moisture absorbing characteristics for enhanced comfort in use of the shoe construction.

As to the manner of usage and operation of the instant invention, the same should be apparent from the above disclosure, and accordingly no further discussion relative to the manner of usage and operation of the instant ivention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A shoe construction, comprising in combination, a shoe upper, the shoe upper formed of a flexible fabric polymeric mesh, and a shoe upper ankle portion mounted to the shoe upper to define an elliptical entrance opening directing access into the shoe construction, wherein a sole member is mounted coextensively to a bottom surface of the shoe upper, and the shoe upper and sole member are defined along a longitudinal axis, and a forward terminal end of the shoe upper at a forward terminal end of the longitudinal axis includes a matrix of ventilation apertures directed therethrough, and a rear vertical upper portion is mounted to a rear terminal end of the shoe at a rear terminal end of the longitudinal axis and extends upwarddly from the sole, with the shoe upper ankle portion including an ankle portion upper terminal end, wherein the rear vertical upper portion extends to the ankle portion upper terminal end, and wherein the entrance opening is defined by an elliptical configuration defined by a minor axis and a major axis, and the rear vertical upper portion extends to the upper terminal end from an upper portion right side to tan upper left side, wherein the upper portion right side and upper portion left side define right and left sides of the entrance opening bisecting by the minor axis of the entrance opening, and wherein the sole member includes an outer row of pneumatic tubes, the pneumatic tubes are arranged in a parallel contiguous relationship extending coextensively along the sole member and along the rear vertical upper portions, and a first resilient polymeric layer defined by a first durometer of hardness laminated to an interior surface of the outer row of pneumatic tubes, and an inner row of pneumatic tubes arranged in a parallel contiguous relationship relative to one another and extend coextensively and interiorly of the outer row of pneumatic tubes and the first resilient ploymeric layer, and wherein the inner row of pneumatic tubes include a central inner row chamber positioned medially within the sole member to provide support for an arch of an individual's foot positioned within t he shoe construction, and including a second polymeric layer defined by a second durometer hardness less than the first durometer of hardness and extends coextensively to an interior surface of the inner row of pneumatic tubes along the sole member, and a third polymeric layer defined by a third durometer of hardness less than the second durometer of hardness impregnated with a charcoal material and mounted coextensively to an interior surface of the second polymeric layer, and including a fluid absorbent fabric liner mounted coextensively within an interior surface of the shoe construction, and wherein the outer row of pneumatic tubes includes a forward matrix of traction tubes mounted orthogonally to the outer row of pneumatic tubes, and a rear matrix of traction tubes mounted orthogonally relative to the outer row of pneumatic tubes, wherein the forward and rear traction tubes are in a spaced relationship and mounted completely within the outer row of pneumatic tubes.

* * * * *